US006589143B2

(12) United States Patent
Taylor

(10) Patent No.: US 6,589,143 B2
(45) Date of Patent: Jul. 8, 2003

(54) PORTABLE BACK PAIN RELIEVING DEVICE

(76) Inventor: Walter J. Taylor, 1501 N. Green St., McHenry, IL (US) 60050

( * ) Notice: Subject to any disclaimer, the term of this patent is extended or adjusted under 35 U.S.C. 154(b) by 0 days.

(21) Appl. No.: 09/897,575

(22) Filed: Jul. 2, 2001

(65) Prior Publication Data

US 2003/0004446 A1 Jan. 2, 2003

(51) Int. Cl.[7] ..... A61H 7/00; A47C 7/42

(52) U.S. Cl. ..... 482/134; 297/230.14; 297/283.3; 297/284.3; 297/284.7

(58) Field of Search ..... 601/23, 134, 137, 601/138, 143, 146; 482/132, 142, 904; 606/237, 240–242; 297/230.1, 230.11, 230.12, 230.13, 230.14, 283.3, 284.3, 284.7; 5/633

(56) References Cited

U.S. PATENT DOCUMENTS

| | | | | | |
|---|---|---|---|---|---|
| 1,562,266 | A | * | 11/1925 | Todd | 606/237 |
| 3,813,148 | A | | 5/1974 | Kraus | |
| 4,097,087 | A | | 6/1978 | Garavaglia | |
| 4,161,337 | A | | 7/1979 | Ross et al. | |
| 4,421,110 | A | * | 12/1983 | DeLisle et al. | 601/134 |
| 4,541,670 | A | | 9/1985 | Morgenstern et al. | |
| 4,634,176 | A | | 1/1987 | Scott | |
| 4,718,724 | A | | 1/1988 | Quinton et al. | |
| 4,862,536 | A | | 9/1989 | Pruit | |
| 4,953,857 | A | * | 9/1990 | Lemire | 482/142 |
| 5,027,795 | A | | 7/1991 | Kato | |
| 5,054,854 | A | | 10/1991 | Pruit | |
| 5,114,209 | A | | 5/1992 | Dunn | |
| 5,215,511 | A | * | 6/1993 | Cheng | 482/142 |
| 5,228,747 | A | * | 7/1993 | Greene | 297/284.3 |
| 5,328,245 | A | * | 7/1994 | Marks et al. | 297/284.3 |
| 5,381,558 | A | * | 1/1995 | Lo | 601/134 |
| 5,403,067 | A | | 4/1995 | Rajaratnam | |
| 5,507,559 | A | | 4/1996 | Lance | |
| 5,518,294 | A | | 5/1996 | Ligon, Sr. et al. | |
| 5,533,787 | A | | 7/1996 | Xiang | |
| 5,547,251 | A | | 8/1996 | Axelson | |
| 5,573,302 | A | | 11/1996 | Harrison et al. | |
| 5,626,390 | A | | 5/1997 | Schuster et al. | |
| 5,676,638 | A | * | 10/1997 | Shefi | 601/143 |
| 5,707,108 | A | | 1/1998 | Pi | |
| 5,820,573 | A | * | 10/1998 | Ramos | 601/134 |
| 6,079,784 | A | | 6/2000 | Peachey | |
| 6,086,152 | A | | 7/2000 | Zeller | |
| 6,089,659 | A | | 7/2000 | Toyota | |
| 6,299,248 | B1 | * | 10/2001 | Gennaro et al. | 297/230.13 |

* cited by examiner

*Primary Examiner*—Nicholas D. Lucchesi
*Assistant Examiner*—Victor Hwang
(74) *Attorney, Agent, or Firm*—Mathew R. P. Perrone, Jr.

(57) ABSTRACT

A back pain reliever has a linear alignment support with at least two bi-pad supports mounted thereon. The linear alignment support runs along the spine of a person with least two bi-pad supports mounted thereon, so each of the two pads of the bi-pad support are on opposite sides of the spine of a person.

18 Claims, 4 Drawing Sheets

PORTABLE BACK PAIN RELIEVING DEVICE

This invention relates to a back pain relieving device, and more particularly to a back pain relieving device for use on either a vehicle seat or any other seat having a back support, or by a person in a supine position.

BACKGROUND OF THE INVENTION

Back pain is a common complaint for a large number of people. In order to minimize back pain, various devices are known to have been developed. Such devices provide some relief. However, it is difficult to obtain a device that provides an adequate and a safe relief from back pain for a person, while that person is driving a vehicle.

Some of the devices for relief of back pain, while the person suffering from the back pain is a rider in or a driver for a vehicle, are too hard and become dangerous in case of an accident. Other devices are not flexible and interfere with the positioning and driving of, or riding in, a vehicle. Thus, it is desired to avoid these difficulties and provide access either to back comfort or reduced back pain, while at the same time minimizing interference with any use of a vehicle.

Also, it is difficult to remove and reinstall a back support device from the vehicle to the house or back. It is also difficult to use the same back support device for the vehicle or the house. It is desired to have a back pain relieving device that accomplishes use or permits the use thereof in both a vehicle or a house.

Furthermore, among the back pain relieving devices of the prior art, it is common for the device to cause a skin injury. It is difficult to provide the device, which can provide the necessary massage, while at the same time, avoids the damage to the skin. The device must be hard enough to provide the pain relief, while at the same time, avoiding damage to the skin.

Thus, a solution for the goal of pain relief can result in skin injury. A solution for the goal of avoiding skin injury reduces pain relief. It is very desirable to maximize the advantages of both situations. No device currently exists to meet those goals.

SUMMARY OF THE INVENTION

Among the many objectives of this invention is the provision of a back pain relieving device providing both ease of removal and ease of storage.

Another objective of this invention is to provide a movable back pain relieving device.

Yet another objective of this invention is to provide a back pain relieving device, which is easily mounted on a vehicle seat.

Still another objective of this invention is to provide a back pain relieving device, which is easily mounted on a chair.

Additionally, an objective of this invention is to provide a back pain relieving device, which has minimal skin damage for the user.

Also, an objective of this invention is to provide a back pain relieving device, which is easily portable.

A further objective of this invention is to provide a back pain relieving device, which is usable in a supine position.

These and other objectives of the invention (which other objectives become clear by consideration of the specification, claims and drawings as a whole) are met by providing a back pain relieving device, the back pain relieving device including a linear alignment support having at least two double pad supports mounted thereon. The linear alignment support runs along the spine of a person with least two double pad supports mounted thereon, so each of the two pads of the double pad support is on opposite sides of the spine of a person.

BRIEF DESCRIPTION OF DRAWINGS

Throughout the figures of the drawings where the same part appears in more than one figure, the same number is applied thereto.

DESCRIPTION OF PREFERRED EMBODIMENTS

Figure 1:
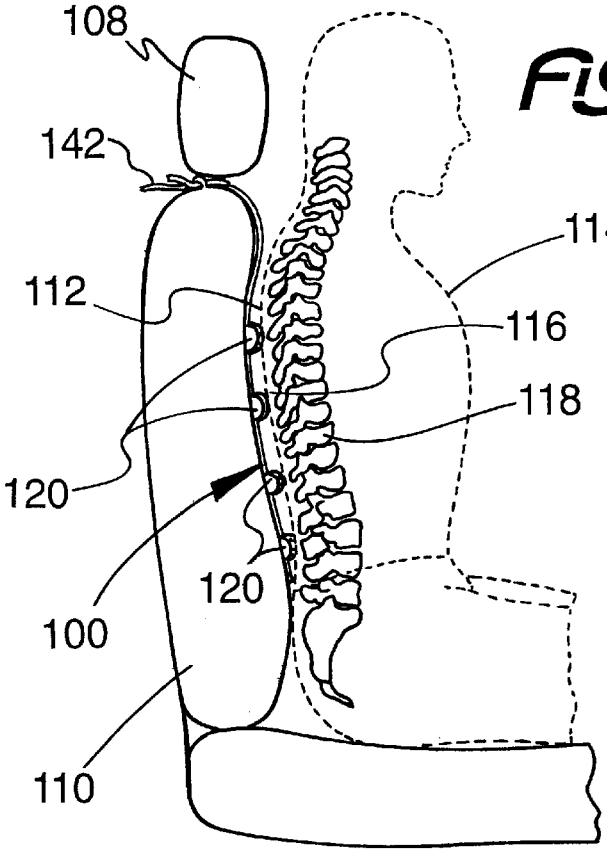
FIG. 1 depicts a side view of back pain relieving device 100 in use on a vehicle seat 110.

This particular invention relates to a back pain relieving device. The back pain relieving device has a center strap or linear alignment support. To the center strap are secured a number of implements or double pads. Each implement has a connection device permitting it to be fastened to the center strap. Preferably, the connection device is centrally located on the implement.

Likewise, on the linear alignment device are pad supports adapted to receive the double pads. A variety of pad supports may be used in this matter.

On either side of the strap, protruding from the connection device on the implements are relatively comfortable enlargements, which combine to form the double pad. These double pads are preferably of a flexible material with a durometer, or hardness, similar to that of skin. While it not desired to be bound by any particular theory, the shape of the double pads combined with the size, positioning, and durometer; the back pain relieving device accomplishes the desired comfort or pain relief for an average person's back. It believed that the back pain relieving will be effective for most, but not all, people.

In this fashion, these double pads permit the back to be comfortable and provide for comfort while riding in a vehicle, or sitting in a chair at home or anywhere. With these devices increasing in size as they move up the back or down the back, great comfort is obtained. Also, the back pain relieving device or device is provided in the back of the person using the device is rendered more comfortably whether sitting in a vehicle or sitting in a chair.

In a preferred form, on the linear alignment support, the double pads are similar in shape, but different in size. The double pads have a graduated size from the top of linear alignment support, with the largest double pad being at or near the top thereof, and the smallest double pad being at or near the bottom thereof. In other words, the mounted double pads get progressively smaller from top to bottom along the length of the linear alignment support.

Also, in a preferred form, on the linear alignment support, one to eight double pads are used. More preferably, on the linear alignment support, two to six double pads are used. Most preferably, on the linear alignment support, three to five double pads are used.

All or none or mixtures of the double pads may have knobs on the top of the pads, as applied to the linear alignment strap. A mixture is preferred, because such a variation in the double pads empirically appears to provide better relief.

Each double pad preferably has two convex sections and a connecting device, each convex section being on opposing sides of the connecting device. These double pads are preferably of a convex flexible material with a durometer, or hardness, similar to that of skin.

The convex flexible pads on either side of the connecting device may have any type of perimeter at the convex edge. Such perimeter may be circular, rectangular, square or polygonal as desired. Preferably, the shape of the perimeter is substantially rectangular with rounded corners.

Referring now to FIG. 1, the back pain relieving device 100 of this invention is depicted as positioned on headrest 108 of vehicle seat 110, by means of mounting line 142. The back 112 of person 114 is assisted by back pain relieving device 100. A series of double pads 120 contact opposing sides 116 of the spine 118, thereby providing comfort to person 114.

Adding FIG. 2, FIG. 3, FIG. 4, and FIG. 5; to consideration, a series of double pads 120 are connected to the alignment ladder 140. Alignment ladder 140 receives and supports as many of double pad 120 as desired. Alignment ladder 140 has a mounting line 142 attached at the top 144 thereof.

Each double pad 120 has a flat central portion 122 with a first convex pad 124 and a second convex pad 126 on either side thereof. For each double pad 120, first convex pad 124 and second convex pad 126 are substantially mirror images of each other. The first convex pad 124 and the second convex pad 126 are generally hemispherical in shape.

If desired, the first convex pad 124 and the second convex pad 126 may have a raised knob surface in that a plurality of raised knobs 130 may be on the outer portion 132 thereof. The raised knobs 130 are preferably set up in a generally square pattern 134. That choice depends on personal preference.

A smooth surface 136 may also be used alone if desired. Combinations of raised knobs 130 and smooth surface 136 may also be used, and generally preferred to either raised knobs 130 and smooth surface 136 alone.

On each alignment ladder 140, the series of double pads 120 have different perimeters 150 for the first convex pad 124 and the second-convex pad 126. Preferably, diameters or perimeters 150 for double pads 120 increase as double pads 120 move up the alignment ladder 140.

As a preferred mounting device for securing double pads 120 to alignment ladder 140, the substantially flat central portion 122 has a raised button 138 thereon oppositely disposed from outer portion 132. Raised button 138 fits through ladder aperture 146 in alignment ladder 140 in a male to female relationship. With the alignment ladder 140 having series of ladder apertures 146, any number of double pads 120 may be secured to alignment ladder 140, as long as there is a ladder aperture 146, therefor.

Clearly, raised button 138 fitting through ladder aperture 146 in alignment ladder 140 permits double pad 120 to be releasably attached to the alignment ladder 140. Each double pad 120 may have a change in position, as well as providing for increased or decreased numbers of double pads 120, on alignment ladder 140.

Alignment ladder 140 is preferably an elongated flat strip of flexible material. Ladder apertures 146 are preferably centrally located along the alignment ladder 140 between the sides thereof, and equally spaced along the length 152 thereof.

Figure 5:
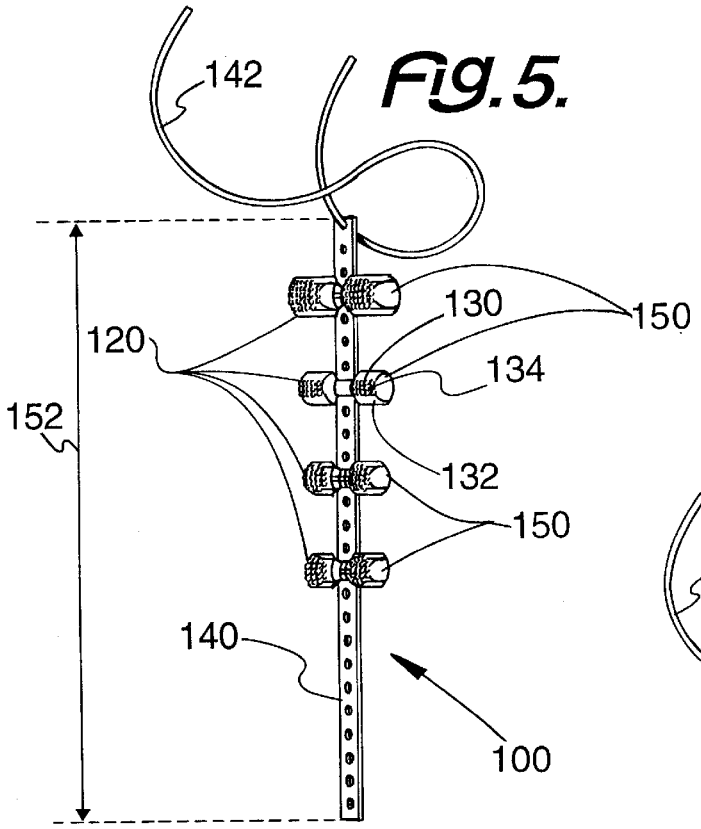
FIG. 5 depicts a front perspective view of the back pain relieving device 100 of this invention.
Figure 6:
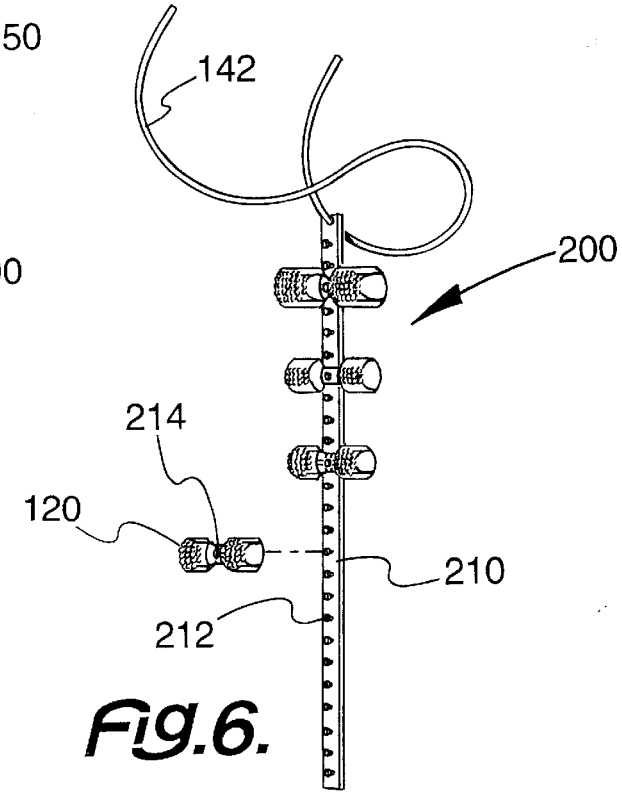
FIG. 6 depicts an exploded perspective view of the button strap back pain relieving device 200 of this invention.

While the particular male to female relationship of the double pads 120 to alignment ladder 140 is preferred for ease of manufacture, it is clearly reversible, as shown in FIG. 6. Alignment ladder 140 of FIG. 5 is replaced with button strap 210 used in button strap back pain relieving device 200. Button strap 210 has a series of strap buttons 212 thereon. Double pad 120 has raised button 138 being replaced with pad aperture 214. The pad aperture 214 may receive a strap button 212, and provide a structure of back pain relieving device 100 similar that of FIG. 2.

Figure 7:
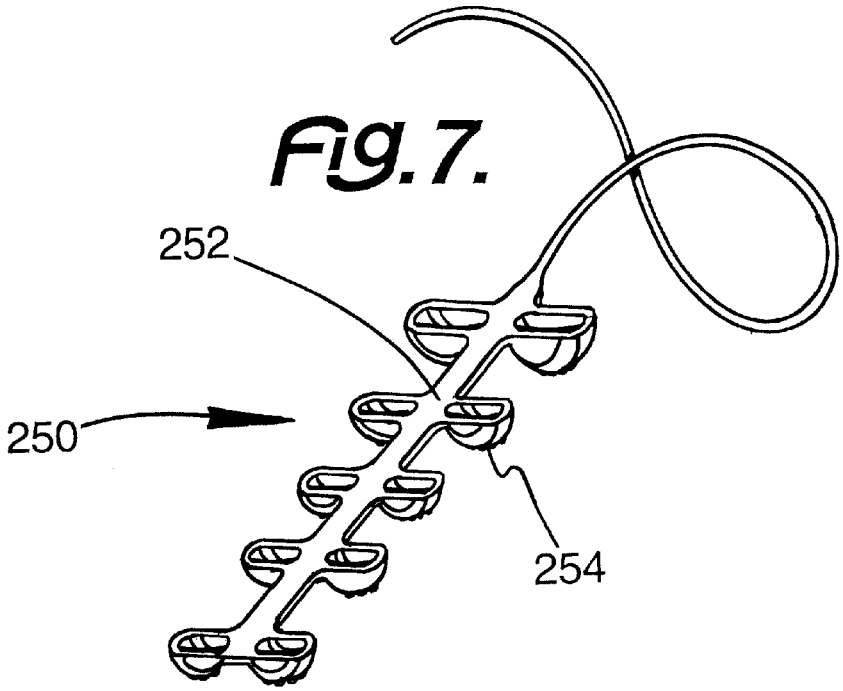
FIG. 7 depicts a rear perspective view of unitary back pain relieving device 250 of this invention.

In FIG. 7, unitary back pain relieving device 250 has central strap 252 with molded pads 254 thereon. Molded pads 254 are permanently attached to central strap 252, because they are part of the molding process. Preferably the molded pads 254 are similar in size and shape to double pads 120 of FIG. 2. However, molded pads 254, while similar in shape to double pad 120 of FIG. 2, the positioning is fixed and not adjustable relative to central strap 252.

Figure 2:
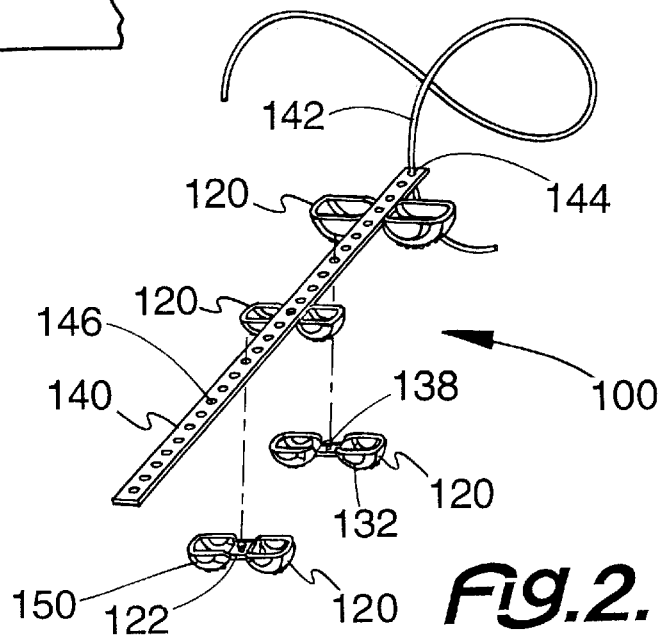
FIG. 2 depicts a partially exploded, perspective view of the back pain relieving device 100 of this invention.
Figure 3:
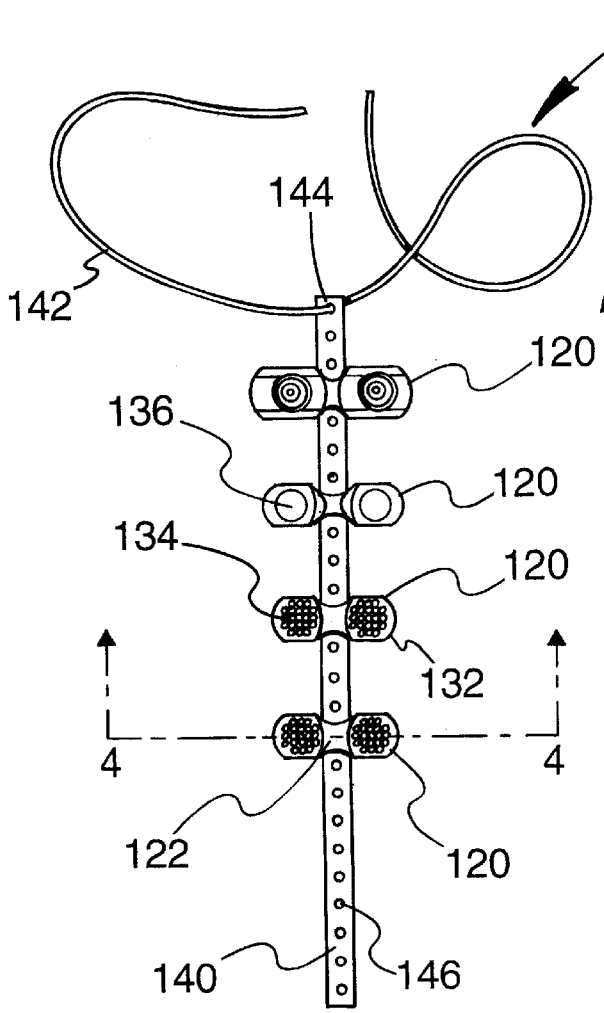
FIG. 3 depicts a top plan view of the back pain relieving device 100 of this invention.
Figure 4:
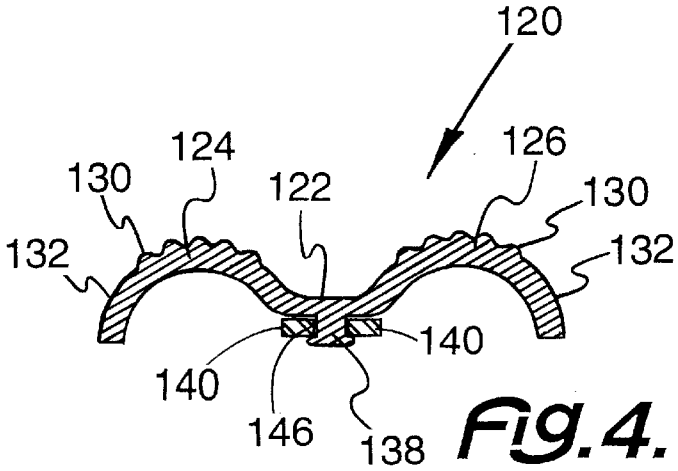
FIG. 4 depicts a side cross-sectioned view of knobbed double pad 120 for back pain relieving device 100 of this invention.

The back pain relieving device 100 of FIG. 2 is believed to be more flexible and more useful, and thus more preferred than unitary back pain relieving device 250. For example, double pads 120 are more easily repositioned on alignment ladder 140.

Figure 8:
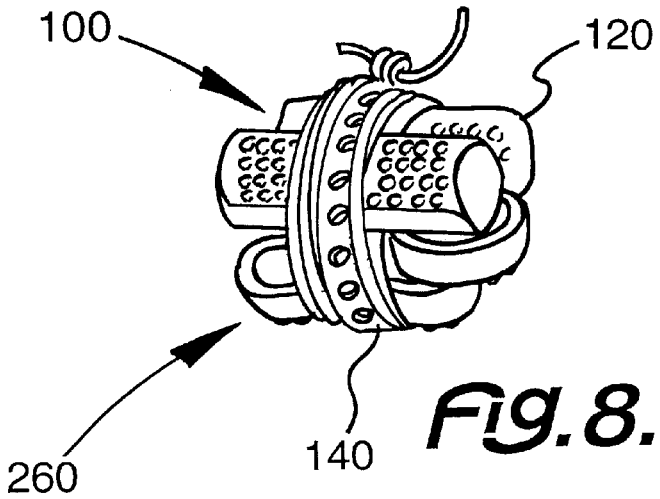
FIG. 8 depicts a perspective view of the back pain relieving device 100 of this invention in stored position 260.

With FIG. 8, the stored position 260 of pain relieving device 100 with double pads 120 on alignment ladder 140. Due to the flexibility of alignment ladder 140 and, to a lesser extent, the flexibility of double pads 120, pain relieving device may be rolled up into stored position 260. In stored position 260, pain relieving 100 may be placed, for example, in a glove compartment of a vehicle (not shown) until use thereof is desired. Similar storage features are available for button strap back pain relieving device 200 or unitary back pain relieving device 250 as desired.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A portable back pain relieving device for use by a person while the person is sitting or reclining comprising:

(a) the back pain relieving device including a flexible linear alignment support having at least two double pad supports thereon and at least two double pads mounted on the at least two double pad supports;

(b) the at least two double pad supports including at least a first double pad support and a second double pad support;

(c) the at least two double pads including at least a first double pad and a second double pad;

(d) each double pad comprising a pair of spaced pad portions for contacting the user's back adjacent the user's spine, the spaced pad portions centered about a spine receiving central portion;

(e) the central portion having a fastening device in order to secure the first double pad to the linear alignment support;

(f) the the at least two double pads becoming progressively smaller from a top to a bottom along a length of the linear alignment support; and (g) the first double pad and the second double pad cooperating with the linear alignment support to relieve back pain.

2. The back pain relieving device of claim 1 further comprising:

(a) the at least two double pads including the first double pad, the second double pad, a third double pad and a fourth double pad;

(b) the linear alignment support having the first double pad, the second double pad, the third double pad and the fourth double pad mounted thereon;

(c) the linear alignment support having a top and a bottom;

(d) the linear alignment support having the first double pad mounted at the top thereof with the second double pad, the third double pad and the fourth double pad proceeding sequentially on the alignment device;

(e) the first double pad being larger than the second double pad;

(f) the second double pad being larger than the third double pad; and (g) the third double pad being larger than the fourth double pad.

3. The back pain relieving device of claim 2 further comprising:

(a) the first double pad having a first convex pad and a second convex pad; and (b) the first convex pad and the second convex pad being on opposing sides of the central portion.

4. The back pain relieving device of claim 3 further comprising:

(a) the at least two double pads having a hardness similar to that of skin;

(b) the fastening device including a pad connecting device;

(c) the first convex pad and the second convex pad having a similar shape; and (d) the first convex pad and the second convex pad being on opposing sides of the linear alignment support.

5. The back pain relieving device of claim 4 further comprising:

(a) the first double pad having the pad connecting device situated between the first convex pad and the second convex pad;

(b) the pad connecting device securing the first double pad to the linear alignment support;

(c) the linear alignment support having at least one pad support thereon; and (d) the fastening device including the at least one pad support and the pad connecting device.

6. The back pain relieving device of claim 5 further comprising the pad connecting device having a releasable male to female relationship with the linear alignment support.

7. The back pain relieving device of claim 5 further comprising the pad connecting device having a releasable female to male relationship with the linear alignment support.

8. The back pain relieving device of claim 5 further comprising the at least two double pad supports being permanently secured to the linear alignment support.

9. The back pain relieving device of claim 4 further comprising:

(a) the first convex pad and the second convex pad each having a perimeter at an edge thereof;

(b) the first convex pad and the second convex pad having the perimeter with a shape selected from the group consisting of a circular shape and a polygonal shape; and (c) the first convex pad and the second convex pad each having a top selected from at least one of a smooth surface and a raised knob surface.

10. The back pain relieving device of claim 9 further comprising the polygonal shape being selected from the group consisting of a rectangular shape and a square shape.

11. The back pain relieving device of claim 9 further comprising the at least two double pad supports being two to eight double pad supports.

12. The back pain relieving device of claim 11 further comprising the at least two double pad supports being three to five double pad supports.

13. The back pain relieving device of claim 12 further comprising the three to five double pad supports having at least one surface selected from the group consisting a knobbed surface and a smooth surface.

14. A portable back pain relieving device for use by a person while the person is sitting or reclining comprising:

(a) the back pain relieving device including a flexible linear alignment support having at least two double pad supports thereon;

(b) the at least two double pad supports including at least a first double pad support receiving a first double pad and a second double pad support receiving a second double pad;

(b) the at least two double pad supports including at least a first double pad support receiving a first double pad and a second double pad support receiving a second double pad;

(c) the first double pad having a central portion;

(d) the central portion having a fastening device in order to secure the double pad to the linear alignment support;

(e) the first double pad being similar in structure to the second double pad; and (f) the first double pad and the second double pad cooperating with the linear alignment support to relieve back pain.

15. The back pain relieving device of claim 14 further comprising:

(a) the at least two double pads including the first double pad, the second double pad, a third double pad and a fourth double pad;

(b) the linear alignment support having the first double pad, the second double pad, the third double pad and the fourth double pad mounted thereon;

(c) the linear alignment support having a top and a bottom;

(d) the linear alignment support having the first double pad mounted at the top thereof with the second double pad, the third double pad and the fourth double pad proceeding sequentially on the alignment device;

(e) the first double pad being larger than the second double pad;

(f) the second double pad being larger than the third double pad; and (g) the third double pad being larger than the fourth double pad.

16. The back pain relieving device of claim 15 further comprising:

(a) the fastening device including a raised button;

(b) the linear alignment support including a plurality of apertures centrally situated along a length of the linear alignment support;

(c) a member of the plurality of apertures receiving the raised button;

(d) the first double pad having a first convex pad and a second convex pad; and (e) the first convex pad and the second convex pad being on opposing sides of the central portion.

17. A back pain relieving device for use by a person while the person is sitting or reclining comprising:

(a) the back pain relieving device including a linear alignment support having at least two double pads mounted thereon;

(b) the at least two double pads including at least a first double pad and a second double pad;

(c) the first double pad having a central portion;

(d) the central portion having a fastening device in order to secure the double pad to the linear alignment support;

(e) the first double pad being similar in shape to the second double pad;

(f) the first double pad and the second double pad being different in size;

(g) the first double pad and the second double pad cooperating with the linear alignment support to relieve back pain;

(h) the at least two double pad supports including the first double pad, the second double pad, a third double pad and a fourth double pad;

(i) the linear alignment support having the first double pad, the second double pad, the third double pad and the fourth double pad mounted thereon;

(j) the linear alignment support having a top and a bottom;

(k) the linear alignment support having the first double pad mounted at the top thereof with the second double pad, the third double pad and the fourth double pad proceeding sequentially on the alignment device;

(l) the first double pad being larger than the second double pad;

(m) the second double pad being larger than the third double pad;

(n) the third double pad being larger than the fourth double pad;

(o) the fastening device including a raised button;

(p) the linear alignment support including a plurality of apertures centrally situated along a length of the linear alignment support; and (q) a member of the plurality of apertures receiving the raised button.

18. The back pain relieving device of claim 17 further comprising:

(a) the at least two double pad supports including a first convex pad and a second convex pad;

(b) the first convex pad and the second convex pad being on opposing sides of the central portion;

(c) the at least two double pad supports having a hardness similar to that of skin;

(d) the first convex pad and the second convex pad each having a perimeter at an edge thereof;

(e) the first convex pad and the second convex pad having the perimeter with a shape selected from the group consisting of a circular shape and a polygonal shape; and (f) the first convex pad and the second convex pad each having a top selected from at least one of a smooth surface and a raised knob surface.

* * * * *